US009790580B1

(12) United States Patent
Yurko et al.

(10) Patent No.: US 9,790,580 B1
(45) Date of Patent: Oct. 17, 2017

(54) METHODS FOR MAKING BULK METALLIC GLASSES CONTAINING METALLOIDS

(71) Applicant: Materion Corporation, Mayfield Heights, OH (US)

(72) Inventors: James A. Yurko, Maumee, OH (US); Edgar E. Vidal, Golden, CO (US); Nicholas W. Hutchinson, Toledo, OH (US)

(73) Assignee: Materion Corporation, Mayfield Heights, OH (US)

( * ) Notice: Subject to any disclaimer, the term of this patent is extended or adjusted under 35 U.S.C. 154(b) by 365 days.

(21) Appl. No.: 14/547,104

(22) Filed: Nov. 18, 2014

Related U.S. Application Data

(60) Provisional application No. 61/905,837, filed on Nov. 18, 2013, provisional application No. 61/936,735, filed on Feb. 6, 2014.

(51) Int. Cl.
*C22C 1/02* (2006.01)
*C22C 45/00* (2006.01)
*C22C 45/04* (2006.01)

(52) U.S. Cl.
CPC ..... *C22C 45/00* (2013.01); *C22C 1/02* (2013.01); *C22C 1/023* (2013.01); *C22C 45/001* (2013.01); *C22C 45/003* (2013.01); *C22C 45/04* (2013.01); *C22C 2200/02* (2013.01)

(58) Field of Classification Search
None
See application file for complete search history.

(56) References Cited

U.S. PATENT DOCUMENTS

| | | | | |
|---|---|---|---|---|
| 3,656,944 | A * | 4/1972 | Brau | C30B 11/00 420/526 |
| 4,582,683 | A * | 4/1986 | Colombo | C22C 7/00 257/442 |
| 6,077,367 | A | 6/2000 | Mizushima et al. | |
| 6,086,651 | A | 7/2000 | Mizushima et al. | |
| 6,235,129 | B1 | 5/2001 | Kojima et al. | |
| 6,749,698 | B2 | 6/2004 | Shimizu et al. | |
| 7,540,929 | B2 | 6/2009 | Demetriou et al. | |
| 7,582,172 | B2 | 9/2009 | Schroers et al. | |
| 7,622,011 | B2 | 11/2009 | Inoue et al. | |
| 7,815,753 | B2 | 10/2010 | Yi et al. | |
| 7,896,982 | B2 | 3/2011 | Johnson et al. | |
| 8,066,827 | B2 | 11/2011 | Demetriou et al. | |
| 8,277,579 | B2 | 10/2012 | Makino | |
| 8,287,665 | B2 | 10/2012 | Urata et al. | |
| 8,361,250 | B2 | 1/2013 | Demetriou et al. | |
| 2003/0000611 | A1* | 1/2003 | Takahashi | B22F 3/1007 148/712 |
| 2003/0039891 | A1* | 2/2003 | Nitta | H01M 4/134 429/231.95 |
| 2004/0154701 | A1 | 8/2004 | Lu et al. | |
| 2006/0054250 | A1 | 3/2006 | He et al. | |

(Continued)

FOREIGN PATENT DOCUMENTS

WO WO2011/159596 A1 12/2011

*Primary Examiner* — George Wyszomierski
(74) *Attorney, Agent, or Firm* — Jones Day

(57) ABSTRACT

Methods and systems for preparing metallic alloys comprising volatile materials such as phosphorus suitable for bulk metallic glasses are described. The methods variously involve carrying out alloying at temperatures and pressures that minimize or counteract sublimation of the volatile species.

23 Claims, 7 Drawing Sheets

(56) References Cited

U.S. PATENT DOCUMENTS

| | | | |
|---|---|---|---|
| 2008/0185076 | A1 | 8/2008 | Schroers et al. |
| 2010/0300148 | A1 | 12/2010 | Demetriou et al. |
| 2010/0310901 | A1 | 12/2010 | Makino et al. |
| 2012/0168036 | A1 | 7/2012 | Demetriou et al. |
| 2012/0168037 | A1 | 7/2012 | Demetriou et al. |
| 2013/0048152 | A1 | 2/2013 | Na et al. |

* cited by examiner

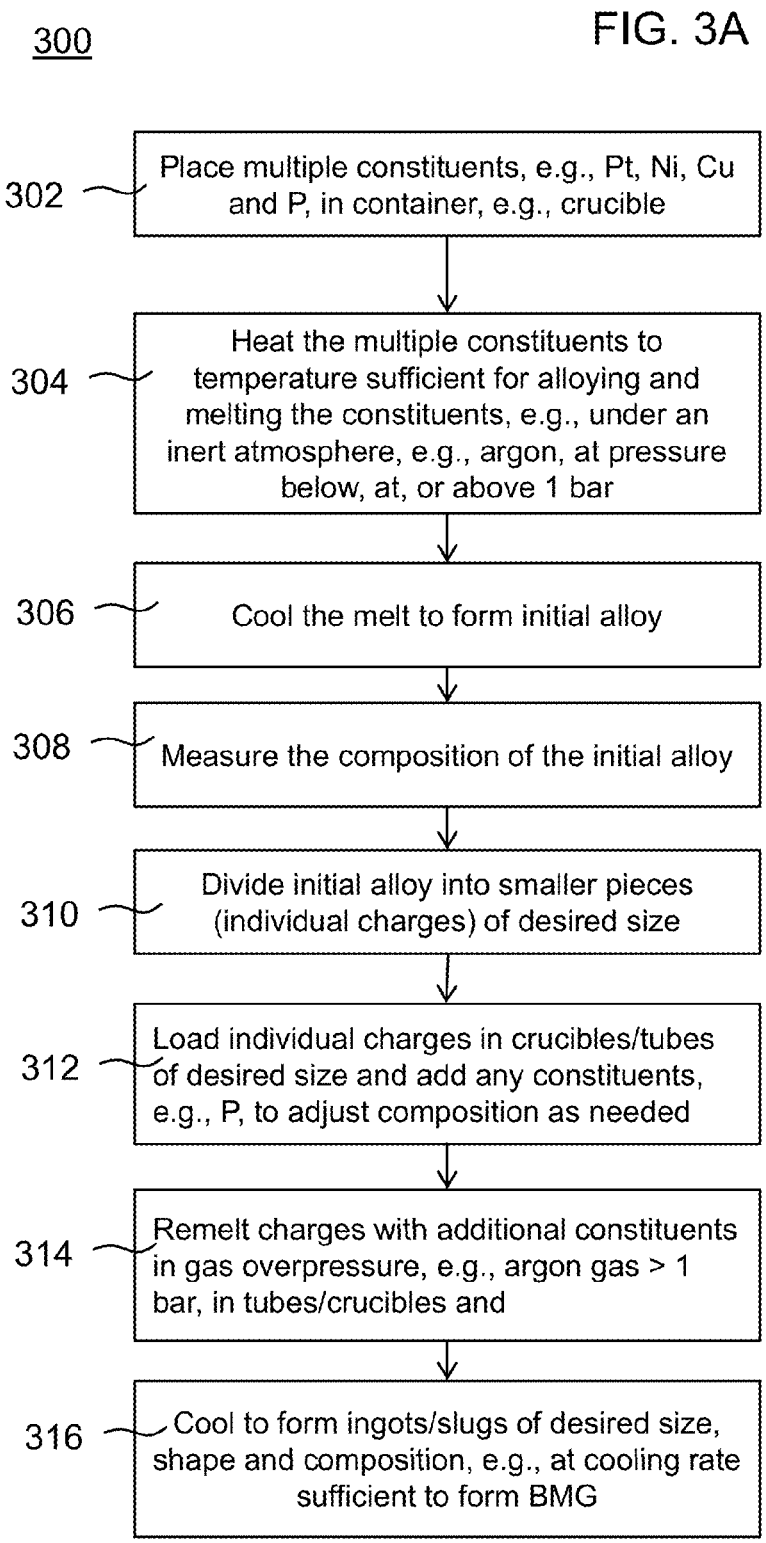
300
FIG. 3A
302
Place multiple constituents, e.g., Pt, Ni, Cu and P, in container, e.g., crucible
304
Heat the multiple constituents to temperature sufficient for alloying and melting the constituents, e.g., under an inert atmosphere, e.g., argon, at pressure below, at, or above 1 bar
306
Cool the melt to form initial alloy
308
Measure the composition of the initial alloy
310
Divide initial alloy into smaller pieces (individual charges) of desired size
312
Load individual charges in crucibles/tubes of desired size and add any constituents, e.g., P, to adjust composition as needed
314
Remelt charges with additional constituents in gas overpressure, e.g., argon gas > 1 bar, in tubes/crucibles and
316
Cool to form ingots/slugs of desired size, shape and composition, e.g., at cooling rate sufficient to form BMG

METHODS FOR MAKING BULK METALLIC GLASSES CONTAINING METALLOIDS

This application claims the benefit of U.S. Provisional Patent Application No. 61/905,837 entitled "Methods for Making Bulk Metallic Glasses Containing Metalloids" filed Nov. 18, 2013 and U.S. Provisional Patent Application No. 61/936,735 entitled "Methods for Making Bulk Metallic Glasses Containing Metalloids" filed Feb. 6, 2014, the entire contentions of each of which are incorporated herein by reference.

BACKGROUND

Field of the Disclosure

The present disclosure relates to metallic alloys, and more particularly to the formation of bulk amorphous metal alloys containing metalloid constituents.

Background Information

Bulk metallic glass (BMG) alloys are a family of materials that, when cooled at rates generally less than 100° C./s, form an amorphous (or non-crystalline) microstructure with thicknesses in the range of 0.1 to 10 mm or greater. BMGs may have unique and novel properties given their lack of long-range order and absence of crystalline structure. BMG alloys may have exceptional strength, high elasticity, limited plasticity, good corrosion and wear resistance, and high hardness relative to their crystalline counterparts. From a processing perspective, the alloys also offer unique possibilities. BMG alloys may have melting temperatures far below their constituent elements, allowing for permanent mold casting processes and other processing such as thermoplastic forming, which are not possible with many conventional alloy systems.

Some good glass forming alloys contain metalloids such as phosphorus (P). While P is often considered a non-metal, it may exhibit borderline metalloid behavior such that it may also be considered a metalloid. Other metalloid elements include boron (B), silicon (Si), germanium (Ge), arsenic (As), antimony (Sb), and tellurium (Te). For example, BMG alloys based on Pt, Pd, Ni, Co, Fe, and/or other elements that contain significant quantities of P may have critical cooling rates as low as 1° C./s or less. Examples of such alloys are described in U.S. Pat. Nos. 7,896,982, 8,066,827, 7,582,172, 7,540,929, 6,749,698, 8,361,250 and U.S. Patent Application Publication Nos. 20120168037, 20120168036, 20100185076 and 20130048152, the entire contents of each of which are incorporated herein by reference.

While such metalloid-containing alloys can be good glass formers and may have desirable properties, the present inventors have observed that their preparation may be cumbersome in view of various challenges presented by the chemistry of such alloys. For instance U.S. Pat. No. 7,540,929 discloses the preparation Pd—Cu—Co—P alloys by placing Pd, Cu, and Co into a quartz tube under an inert atmosphere, e.g., Ar or He, and inductively heating those constituents to produce a pre-alloy of Pd—Cu—Co. P is added to the pre-alloy, the quartz tube is sealed under an inert atmosphere, and heat is added by increasing the temperature intermittently to accommodate the rising gas pressure of the subliming phosphorous.

The present inventors have observed a need for improved approaches of preparing such alloys. Exemplary approaches described herein may address such needs.

SUMMARY

According to another example, a method of preparing a metallic alloy comprises placing multiple constituents into a container; heating the multiple constituents in the container to a temperature sufficient to initiate an alloying reaction among the multiple constituents in the presence of an inert atmosphere at a pressure sufficient to counter sublimation of a first constituent which is a volatile species of the multiple constituents; forming a melt of the multiple constituents; and cooling the melt, thereby forming the metallic alloy. The cooling may be carried out a rate sufficient to cool the melt to a bulk metallic glass structure.

According to another example, a method of preparing a metallic alloy, comprises: placing multiple constituents into a glass tube; evacuating and sealing the tube; heating the multiple constituents in the tube to an alloying temperature sufficient to initiate an alloying reaction among at least some of the multiple constituents with the tube in the presence of an external first pressure that is sufficient to counteract the vapor pressure of any volatile species inside the tube, e.g., such that the first pressure is approximately equal to an expected vapor pressure inside the tube, forming a melt of the multiple constituents; and cooling the melt, thereby forming the metallic alloy. The cooling may be carried out a rate sufficient to cool the melt to a bulk metallic glass structure. The alloying temperature may be above or below a liquidus temperature of any two or more of the constituents. In one example, the tube can be heated above a softening temperature of the tube, e.g., so that the tube collapses on the multiple constituents, e.g., during the alloying process.

BRIEF DESCRIPTION OF THE FIGURES

These and other features, aspects, and advantages of the present disclosure will become better understood with regard to the following description, appended claims, and accompanying drawings.

FIG. 3A illustrates a flow diagram of an exemplary approach for preparing a metallic alloy such as a BMG.

DETAILED DESCRIPTION OF EXEMPLARY EMBODIMENTS

BMG alloys may contain combinations of three or more different elements, and some of the best BMG alloy forming systems contain four or five or more elements. Often, the elements are quite different from one another (early or late transition metal, metalloid, etc.) and form deep eutectic systems. This suggests that the thermodynamically disparate elements are more stable as a molten solution than in a solid-state. It is believed that the elements in such molten solutions encounter difficulty arranging into a crystal structure during solidification, and this allows the alloy to remain as an undercooled liquid and eventually a metallic glass. The best glass forming alloys generally have the slowest critical cooling rates, and this allows for a wider processing window for robust processing and production. Many of the alloys recognized as the best glass formers (slow cooling rates) contain the metallic element Be, or metalloids such as P or B.

Besides the unique combinations of alloying elements, BMG alloys may require tight alloy composition, contaminant, and inclusion control to maintain high glass forming ability. Oxygen, carbon, and nitrogen are usually unfavorable for glass forming ability. It is believed that these elements may enhance nucleation of a solid phase during cooling from the liquid state to below the glass transition temperature. Other elements that promote formation of stable solid phases (e.g., Fe contaminants in Zr-based Vitreloy alloys) are also detrimental. Production of alloys that achieve the desired chemistry while avoiding contaminants is a manufacturing challenge.

The present inventors have developed approaches for preparing metallic alloys including BMG alloys containing volatile constituents, such as the metalloid constituent phosphorus (P). The present inventors have observed that obtaining the desired chemistry of metallic alloy comprising volatile constituents, such as P, can be challenging. The most common form of P, known as red phosphorus, undergoes sublimation at 415° C. While P is relatively stable when in solution in an alloy, e.g., BMG alloys, P is highly volatile at the melting temperatures necessary to make desired alloy compositions. The approaches described herein are designed so that a substantial amount of volatile constituent, e.g., P, goes into the alloy, and does not, instead, end up as vapor that condenses on structures in the alloy production chamber.

Figure 1:
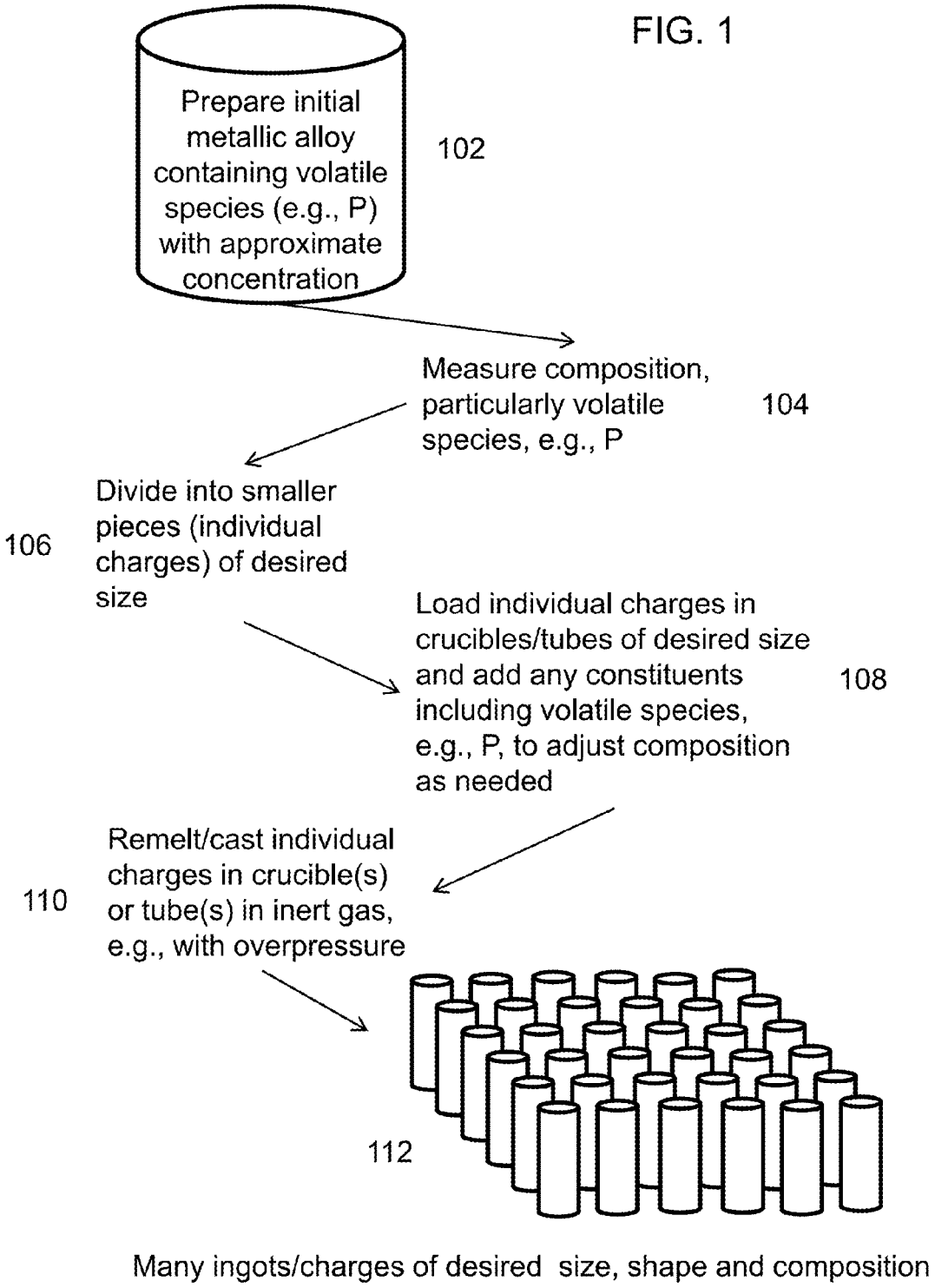
FIG. 1 illustrates an overview of an exemplary approach for preparing a metallic alloy such as a BMG.

FIG. 1 illustrates an overview of an exemplary approach for forming a metallic alloy, e.g., a BMG of Pt—Ni—Cu—P of composition such as identified herein or other composition. An initial alloy (also called a starting alloy or a pre-alloy) may prepared (melted) containing a volatile species, e.g., P, such that the alloy has a composition that is approximate or close to that which is ultimately desired using any suitable furnace arrangement (102). This initial melt may be of any desired size, e.g., 3 kg, 5 kg, 10 kg, 25 kg, 50 kg, etc. The composition of the initial alloy is then measured (104) using any suitable technique, e.g., x-ray microanalysis or wet chemical analysis. The initial alloy may then be divided into smaller pieces (which may be referred to as individual die cast charges or simply individual charges) of a desired size, e.g., 25 grams, 50 grams, 100 grams, etc., and loaded into glass or quartz tubes or other conventional crucibles of a desired size, and additional constituent(s) are added as necessary to adjust the composition as needed (108) based on the measured composition of the initial alloy. The charges are then remelted and cast in the crucibles/tubes in a gas overpressure, e.g., an overpressure of argon in a suitable furnace to produce individual ingots (also called slugs or charges) of the desired size and desired composition (110). The result is many ingots or slugs of desired size, shape and composition (112).

Figure 2:
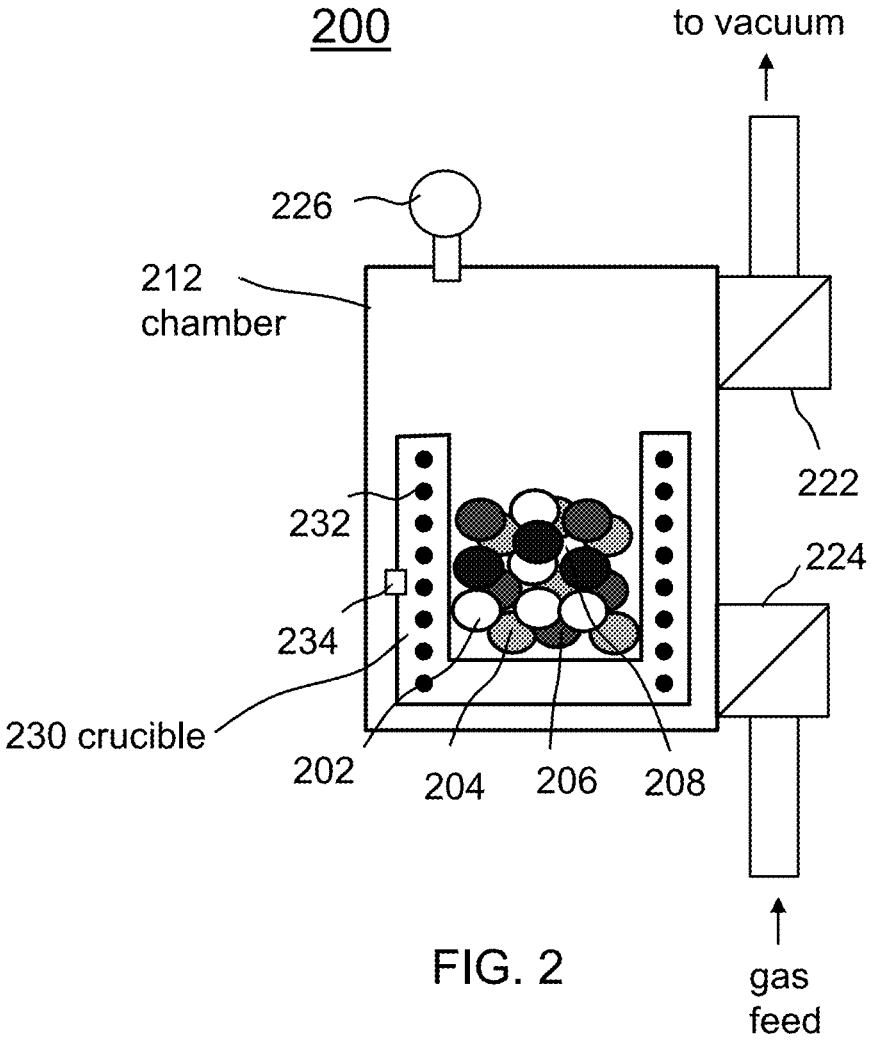
FIG. 2 illustrates an exemplary apparatus and approach for preparing a metallic alloy such as a BMG.

FIG. 2 shows an exemplary apparatus and approach for forming a metallic alloy, e.g., a BMG of Pt—Ni—Cu—P of composition such as identified herein or other composition, using a heating apparatus 200 that may be capable of providing both a vacuum environment as well as an overpressure environment. Reference will also be made to the flow diagram of FIG. 3A. In this example, the apparatus 200 comprises a vacuum chamber 212, a crucible 230 with heating element(s) 232. A vacuum valve 222 connected to a port of the vacuum chamber 212 is connected to a vacuum system to evacuate the chamber 212 and maintain a desired level of pressure/vacuum in the chamber 212. A valve 224 is connected to a port on the vacuum chamber 212 to permit gas, e.g., inert gas such as argon, helium, nitrogen, etc., to be fed into the chamber 212 to maintain a desired gaseous environment in the chamber 212 at a desired pressure, including an overpressure, as well as to purge the chamber of contaminants through alternating evacuation and back filling with inert gas. One or more pressure sensors 226 may be provided for measuring the pressure in the vacuum chamber 212. Any suitable combination of gas flow controllers, pressure sensors, vacuum pumps and associated vacuum plumbing may be utilized to control the vacuum/pressure conditions and gaseous environment of the vacuum chamber 212, e.g., in the range of one bar to several bars or more, (e.g., about 2, 3, 4 or 5 bars, 6-10 bars, or more) wherein one bar is atmospheric pressure (760 Torr), to sub-ambient pressures less than atmospheric pressure (e.g., a few hundred Torr to $10^{-6}$ Torr), including low vacuums (e.g., $10^{-2}$-$10^{-6}$ Torr, for instance). One or more temperature sensors 234 (e.g., thermocouples) for measuring the temperature of one or more locations of the crucible 130 may be provided, e.g., to monitor the temperature of the crucible 230.

As shown in FIG. 2 and at step 302 of FIG. 3, multiple constituents 202, 204, 206, 208, are placed into a container, e.g., crucible 230. These constituents may include, for instance, Pt, Ni, Cu, and a volatile constituent such as P. While a crucible 230 is shown as the exemplary container in FIG. 2, the container could be a quartz tube fused at one end and equipped with a suitable compression fitting connected to suitable vacuum/gas plumbing to evacuate the tube and control the gaseous environment in the tube. The container, e.g., crucible 230 may be heated by an induction heating coil 232, or by any other suitable means of heating, to promote alloying and melting of the constituents (step 304). In one example, a molten pre-alloy, e.g., of Pt—Ni—Cu can be formed, and a suitable amount of a volatile species, e.g., P, can be added thereafter to the pre-alloy, e.g., while the pre-alloy is still molten from an initial melting process or during a subsequent heating/melting process. Some of the volatile species will sublime during melting, but much of it will go into the alloy. Alternatively, the volatile species can be included, e.g., mixed in, with the other constituents at the outset prior to heating and melting. In this case, step 304 can be carried out, if desired, by adjusting the temperature such that at least some of the volatile species is taken up by other constituents via a solid-state diffusion reaction prior to melting. Also, some of all of the constituents may already be in the form of other alloys themselves, e.g., Pt—Ni, Pt—Cu, Ni—Cu, Pt—P, Cu—P, Ni—P, etc. The heating of the multiple constituents in the container can be carried out to achieve a temperature sufficient to initiate an alloying reaction among the multiple constituents in the presence of an inert atmosphere at a pressure sufficient to counter sublimation of a first constituent, e.g., P, which is a volatile species of the multiple constituents. For instance, the heating and melting may be carried out in an inert atmosphere at a pressure of less than, equal to, or greater than 1 bar. A positive pressure, e.g., of several bars or more, e.g., of Argon, or other inert gas, may be used in the chamber to reduce to at least some extent the sublimation of any volatile species of the constituents being melted. In some examples, heating and/or melting can be done in the presence of an inert gas at a pressure suitable to counter or reduce sublimation of the volatile species that would otherwise occur at substantial vacuum conditions. For example, heating and/or melting can be done in the presence of an inert gas such as Argon at a pressure in the range of about 250-380 Torr. As another example, heating and/or melting can be done in the presence of an inert gas such as Argon at a pressure in the range of about 380-700 Torr, and in particular at about 380 Torr. As another example, heating and/or melting can be done in the presence of an inert gas such as Argon at a pressure in the range of about 700-760 Torr. As another example, heating and/or melting can be done in the presence of an inert gas such as Argon at a pressure in the range of about 1.5-2 bars. As another example, heating and/or melting can be done in the presence of an inert gas such as Argon at a pressure in the range of about 2-4 bars, 4-6 bars, 6-10 bars, or more. As another example, heating and/or melting can be done in the presence of an inert gas such as Argon at a pressure of about 0.5 psi above atmospheric pressure. Under such conditions, the heating and/or melting may be carried out such that the pressure of the inert gas is controlled to remain substantially constant during the heating and/or melting process virtue of providing a controlled gaseous environment with suitable plumbing and gas control. Without such control, a container that is entirely sealed with an inert gas environment at a given pressure at room temperature would undergo substantial pressure changes due to the heating of the ambient gas during the heating and/or melting process. Moreover, the heating may be applied in a continuous manner as opposed to intermittently. References to the word "about" when used herein may be understood to mean within ±5% of the stated value.

Thereafter, the melt may be cooled (step 306), e.g., by pouring the melt into a desired mold, thereby forming a metallic alloy, which may be an initial metallic alloy that may undergo further processing and remelting. Or if the melting were carried out in a quartz tube, for example, the melt could be cooled by water quenching, e.g., by inserting the tube containing the melt into a water bath or by pouring the melt from the tube into a water bath. The composition of the alloy (e.g., initial alloy) can be measured at step 308, if desired. A determination is made on what constituent(s) to add, if any, and in what amount(s) to bring the alloy to the desired composition, e.g., through a further melting process with whatever additional constituents are warranted.

At step 310 the initial alloy can be divided into smaller pieces (which may be referred to as individual die cast charges or simply individual charges) of a desired size, e.g., 25 grams, 50 grams, 100 grams, etc. At step 312 the individual charges are loaded into glass or quartz tubes or other conventional crucibles of a desired size, and additional constituent(s) are added as necessary to adjust the composition as needed (108) based on the measured composition of the initial alloy. For instance, depending upon the concentration of P in the initial alloy, additional P of the necessary amount may be added to the tube(s) containing the charge(s) of the initial alloy so as to remedy any deficiency in P due to sublimation of P during the melting of the initial alloy.

At step 314, the charge(s) can be remelted with additional constituent(s) if desired or warranted, e.g., P, in the crucibles/tubes at a suitable gas pressure, e.g., at a positive pressure >1 bar (also referred to as an overpressure) of argon or other inert gas in a suitable furnace, and cooled at step 316 so as to cast individual ingots (also called slugs or charges) of the desired size and desired composition. The result is many ingots or slugs of desired size, shape and composition. This step can be carried out in a different chamber/furnace system than that used for the prior heating/melting, or in the same chamber/furnace system used for the prior heating/melting but with a different crucible/heater arrangement, for instance. For example, this step can be carried out, if desired, in a hot isostatic press (HIP) apparatus, or pressurized furnace apparatus, such as that schematically illustrated in FIG. 4, which is described further below.

The cooling referred to at step 316 can be done at any desired rate. For instance, the cooling could be carried out slowly, such that the resulting ingots or slugs have a crystalline or partially crystalline structure, in which case they may be used as charges for later remelting and casting at a sufficient cooling rate into BMG materials or parts. For instance, BMG ingots or slugs may be cast at diameters on the order of 1 mm to 10 mm or larger (e.g., between 1 mm and 5 mm, between 5 mm and 10 mm, between 10 mm and 20 mm, greater than 20 mm, etc.) directly from the melt at relatively slow critical cooling rates depending upon the particular BMG composition. Alternatively, the cooling at step 314 may be carried out sufficiently quickly by suitable quenching, e.g., water quenching, so that the resulting ingots or slugs will already have a BMG structure, i.e., are cooled directly to an amorphous state. These ingots or slugs can then be used for further molding processes into BMG parts. The cooling may be carried out, for example, at a rate sufficient to avoid the formation of Pt—P intermetallic compounds, so as to permit solidification of the melt directly to a bulk amorphous structure.

Also, the melting at step 314 and cooling at step 316 can be carried out in a vacuum controlled counter gravity casting apparatus, such that the melt can be cast into any suitable counter-gravity-casting mold with less turbulence and potentially greater control of the casting process. In this case, the cooling can be carried out slowly or quickly such as described above to obtain resulting ingots of either crystalline or BMG structure. In any of these options, the choice of suitable temperatures, heating times and pressures can be determined from experimental testing and/or modeling. For example, the melt could be cast using counter gravity casting such as disclosed in copending U.S. patent application Ser. No. 13/840,445 filed Mar. 15, 2013, the entire contents of which are incorporated herein by reference.

In the processes described herein, the volatile species, e.g., P, may be in powder form, but other forms are possible as well. For instance, where the final desired alloy comprises Pt, Cu, Ni and P, the P could be provided via a pre-alloy of Pt and P, a pre-alloy of Cu and P, or a pre-alloy of Ni and P, the form of which could be foil, small pieces of alloy, etc. Moreover, to the extent that P is assembled or pre-alloyed with Cu or Ni, the desired Pt could be provided in the form of Pt sponge. Generally speaking, for example, the Pt can be provided in the form of shot or sponge, Cu and Ni can be provided in the form of small chunks, and P can be provided in the form of powder. However, these and other constituents can be provided in other forms as well, such as may be dictated by availability, cost, and the like.

In one example, heating of constituents including the volatile species could be done to a temperature sufficient to promote a solid state diffusion alloying reaction, e.g., while maintaining the temperature below a sublimation temperature and, e.g., below a melting temperature of the volatile species, e.g., P. Red phosphorus undergoes sublimation at 415° C. Thus, where P is used, the initial heating could be carried out to a temperature below 415° C., e.g., 400° C., for a time sufficient to promote an initial solid state reaction with the another constituent 104, e.g., Pt, Cu or Ni, to a sufficient degree that further heating to a higher temperature will not result in excessive sublimation of the volatile species. And as noted previously, heating and/or melting can be done in the presence of an inert gas at a pressure suitable to counter or reduce sublimation of the volatile species that would otherwise occur at substantial vacuum conditions. For example, heating and/or melting can be done in the presence of an inert gas such as Argon at a pressure in the range of about 250-380 Torr. As another example, heating and/or melting can be done in the presence of an inert gas such as Argon at a pressure in the range of about 380-700 Torr, and in particular at about 380 Torr. As another example, heating and/or melting can be done in the presence of an inert gas such as Argon at a pressure in the range of about 700-760 Torr. As another example, heating and/or melting can be done in the presence of an inert gas such as Argon at a pressure in the range of about 1.5-2 bars. As another example, heating and/or melting can be done in the presence of an inert gas such as Argon at a pressure in the range of about 2-4 bars, 4-6 bars, 6-10 bars, or more. As another example, heating and/or melting can be done in the presence of an inert gas such as Argon at a pressure of about 0.5 psi above atmospheric pressure. Under such conditions, the heating and/or melting may be carried out such that the pressure of the inert gas is controlled to remain substantially constant during the heating and/or melting process virtue of providing a controlled gaseous environment with suitable plumbing and gas control. Without such control, a container that is entirely sealed with an inert gas environment at a given pressure at room temperature would undergo substantial pressure changes due to the heating of the ambient gas during the heating and/or melting process. Moreover, the heating may be applied in a continuous manner as opposed to intermittently.

Figure 3B:
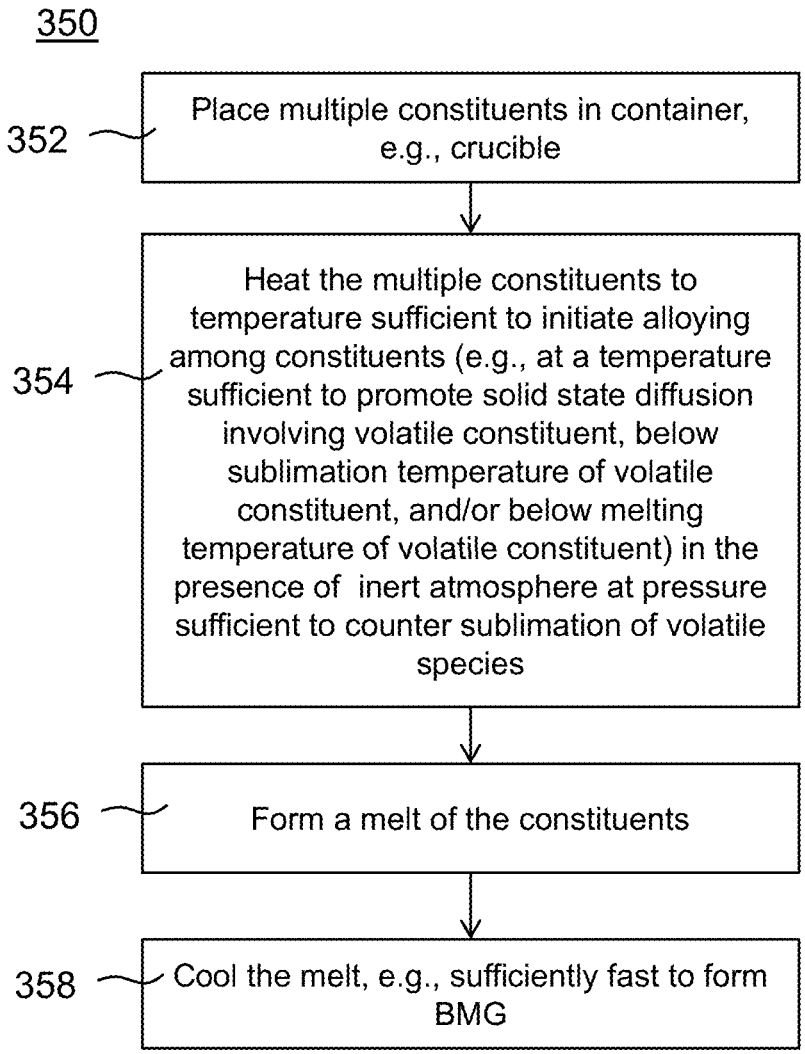
FIG. 3B illustrates a flow diagram of an exemplary approach for preparing a metallic alloy such as a BMG.

According to another example, an exemplary approach illustrated in the flow diagram of FIG. 3B may used to prepare a metallic alloy, e.g., a BMG composition, utilizing an apparatus such as shown in FIG. 2 or using a container such as a quartz tube with suitable a suitable compression fitting and vacuum/gas plumbing to control the environment in the tube. In this approach, heating the constituents may be carried out under a positive pressure of inert gas to counter the sublimation of the volatile species, e.g., P. As noted above, a positive pressure of several bars or more, e.g., of Argon, or other inert gas, may be used in the chamber to reduce to at least some extent the sublimation of any volatile species of the constituents being melted. In this regard, multiple constituents may be placed into a container, e.g., crucible 230 or quartz tube (step 352). The constituents can be provided in any suitable form, e.g., powder, chunks, sponge, etc. Instead of providing the constituents in elemental form, this approach can also be carried out by first creating a pre-alloy of Pt—P, Ni—P or Cu—P, for example, and providing that pre-alloy as one of the constituents. In either case, at step 354, the multiple constituents are heated to a temperature sufficient to initiate alloying among the constituents in the presence of an inert atmosphere at a pressure sufficient to counter sublimation of the volatile species, e.g., P. For instance, the temperature may be a temperature sufficient to promote solid state diffusion involving volatile constituent, a temperature below sublimation temperature of volatile constituent, and/or a temperature below melting temperature of volatile constituent. At step 356, a melt is formed from the constituents, e.g., by adding additional heat if necessary, and at step 358, the melt is cooled, e.g., e.g., by pouring the melt into a desired mold for casting, thereby forming the metallic alloy. For instance, the melt may be poured into a cooled copper or stainless steel mold to cool it, for example, at a cooling rate sufficient to form a BMG alloy. The choice of suitable temperatures, heating times and pressures can be determined from experimental testing and/or modeling. Alternatively, the alloy may be cast using counter gravity casting such as described in copending U.S. patent application Ser. No. 13/840,445 filed Mar. 15, 2013.

Figure 4A:
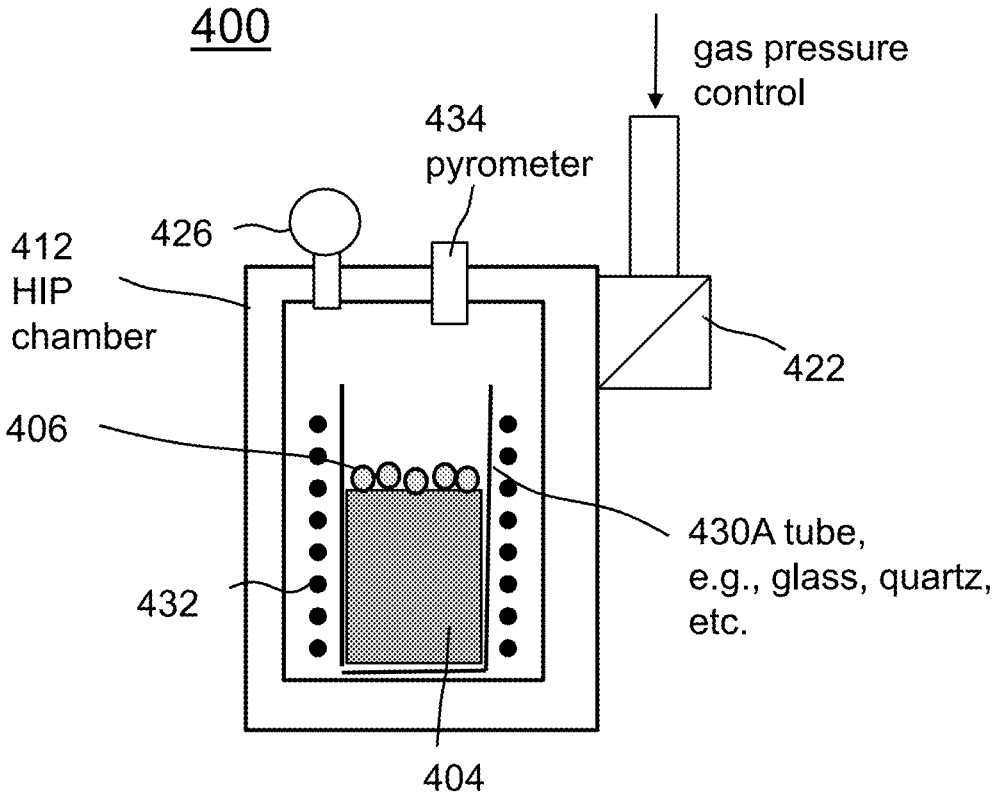
FIG. 4A illustrates an exemplary apparatus and approach for preparing a metallic alloy such as a BMG.

As noted above, a pressured furnace system, e.g., a hot-isostatic-press (HIP) apparatus, can be used to carry out the heating at step 304 or the remelting referred to at step 314 of FIG. 3A, or the heating and melting referred to at steps 354 and/or 356 of FIG. 3B. FIG. 4A illustrates an exemplary hot isostatic press (HIP) or pressurized furnace apparatus 400 in this regard. The apparatus 400 includes a chamber 412, valving 422 to control the pressure in the chamber, a heating source 432, e.g., an induction heating element or other suitable heater, one or more pressure sensors 426 for measuring the pressure in the chamber 412, and a temperature sensor 434, such as a pyrometer or thermocouple. A broad range of pressures can be provided by the HIP apparatus or pressurized furnace apparatus 400, ranging from atmospheric pressure to tens of thousands of PSI.

In the example of FIG. 4A, an initial alloy 404 that has been previously prepared, and which may already contain an amount of the volatile species, is placed into a container 430A, e.g., a borosilicate glass tube or quartz tube along with an appropriate amount of the additional constituent(s) 406 of volatile species, e.g., P, as described previously, and optionally along with a boron oxide flux. A tube as referred to herein may have any suitable cross sectional shape, e.g., circular, oval, square, rectangular, etc. Heat may then be applied to melt the initial alloy 404 and the additional constituent(s) 406 together (and optionally with the boron oxide flux) to form a final alloy of the desired composition, i.e., with the proper amount of the volatile species. As an alternative, the initial alloy 404 can be melted first in the container 430A (optionally with boron oxide flux) prior to adding the additional constituent 406 of the volatile species, e.g., P. In some examples, the geometry of the tube 430A, the size of the initial alloy 404 and the placement of the induction coils of the heating source 432 can be arranged such that the volatile species 406 can be positioned away from, e.g., above or below, the spatial position of the induction coils. This can reduce the extent of sublimation of the volatile species 406. In either case, some sublimation of the volatile species may be expected to occur, and the proper amount of the additional constituent(s) 406 of volatile species can be tailored via chemical testing to determine this proper amount. Also, in either case, the heating and melting of the initial alloy 404 and the additional constituent(s) 406 of volatile species can be carried out at a suitable pressure in an inert gas such as Argon, e.g., at pressures ranging from 250-380 Torr, 380-700 Torr, 700-760 Torr, at a pressure of 0.5 psi above atmospheric pressure, at an overpressure of greater than 1 bar, e.g., 1.5-2 bars, 2-4 bars, or substantially higher pressure, to counter or reduce the sublimation of the volatile species that would otherwise occur at much lower pressures or vacuum conditions. Determination of a suitable pressure or pressures of inert gas to reduce the sublimation of the volatile species inside the tube 430A can determined in advance with experimental testing. As noted previously, the heating and/or melting may be carried out such that the pressure of the inert gas is controlled to remain substantially constant during the heating and/or melting process virtue of providing a controlled gaseous environment with suitable plumbing and gas control. Without such control, a container that is entirely sealed with an inert gas environment at a given pressure at room temperature would undergo substantial pressure changes due to the heating of the ambient gas during the heating and/or melting process. Moreover, the heating may be applied in a continuous manner as opposed to intermittently.

While only one container or tube 430A is illustrated in the system of FIG. 4A, it should be appreciated that the system of FIG. 4A may have many containers or tubes 430A arranged therein with a suitable heating source or sources 432 so that many charges of alloy can be remelted at processed at the same time, e.g., 10, 20, 30, 40, 50, 60, 80 or 100 containers/tubes 430A or more.

Figure 4B:
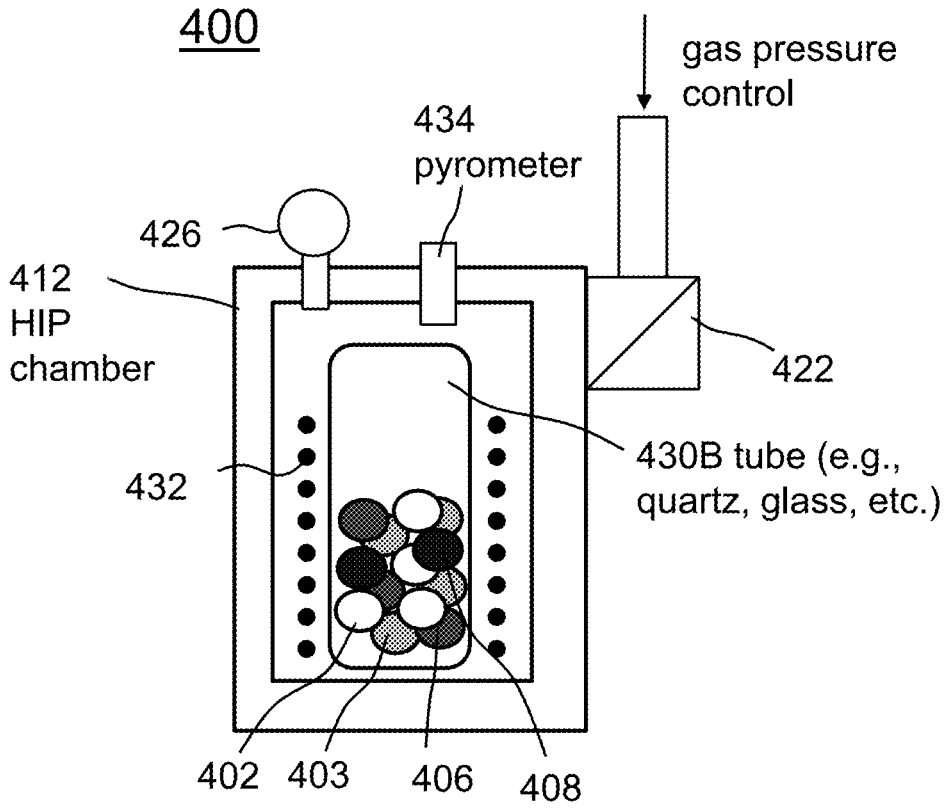
FIG. 4B illustrates an exemplary apparatus and approach for preparing a metallic alloy such as a BMG.

FIG. 4B illustrates another exemplary system and approach for melting an alloy, e.g., a BMG composition, containing a volatile constituent, such as P, using a hot isostatic press (HIP) or pressurized furnace apparatus 400. Reference will also be made to the flow diagram for the exemplary approach 500 shown in FIG. 5. The apparatus 400 includes a chamber 412, valving 422 to control the pressure in the chamber, a heating source 432, e.g., an induction heating element or other suitable heater, one or more pressure sensors 426 for measuring the pressure in the chamber 412, and a temperature sensor 434, such as a pyrometer or thermocouple. A broad range of pressures can be provided by the HIP apparatus or pressurized furnace apparatus 400, ranging from atmospheric pressure to tens of thousands of PSI.

Figure 5:
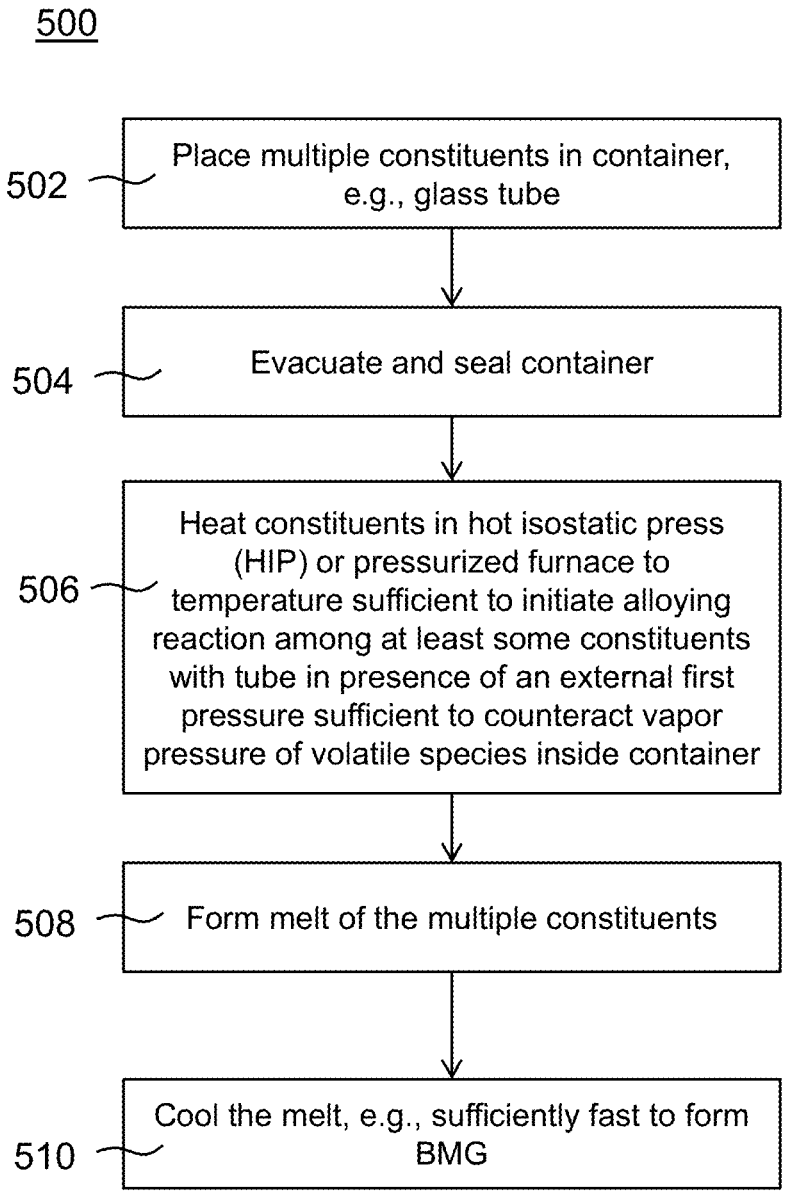
FIG. 5 illustrates a flow diagram for an exemplary approach for preparing a metallic alloy such as a BMG.

In the approach of FIG. 4, multiple constituents are placed into a container 430B, e.g., a borosilicate glass tube or quartz tube, which may be deformable at an elevated temperature (step 502 of FIG. 5). A tube as referred to herein may have any suitable cross sectional shape, e.g., circular, oval, square, rectangular, etc. In one example, the constituents are provided as powders and mixed together before being placed into the container. The container 430B can then be evacuated and sealed (step 504). The multiple constituents 402, 403, 406, 408, etc., in the container 430B are then heated to a temperature sufficient to initiate an alloying reaction among the multiple constituents, e.g., a temperature sufficient to initiate a solid state reaction (step 506), with the tube in the presence of an external first pressure sufficient to counteract, i.e., oppose, the expected vapor pressure of any volatile species inside the tube, which could be determined in advance with experimental testing. The counteracting external pressure does not necessarily need to prevent or counter sublimation or reduce vapor pressure of the volatile species (though it may do so), but it does provide an opposing pressure that may aid in preventing the tube from bursting due to too high a pressure inside the tube. For example, the first external pressure could be approximately equal to the expected vapor pressure in the tube, or slightly above or below. The expected vapor pressure could be determined in advance from experimental testing. In addition, initiating alloying with a solid state reaction can be beneficial to consume the volatile species, e.g., P, so as to minimize the extent of sublimation of the volatile species. As an example, in the case of the Pt—Cu—Ni—P alloy, a borosilicate glass tube or quartz tube could be filled with Pt powder, sponge, or foil pieces, as well as powders of P, Cu, or Ni (or other small length-scale forms such as foil pieces or small spheres). Another alternative could use a combination of Pt, P, Cu, Ni or also master alloys made of either Pt—P, or Cu—P, or Ni—P. The melting temperature of $Pt_{57.5}Cu_{14.7}Ni_{5.3}P_{22.5}$ alloy system is 560° C., so it envisioned that temperatures of 560° C. or less would promote solid-state diffusion and the desired chemistry. Furthermore, the application of pressure should counteract the vapor pressure of P, minimizing vapor loss.

In one example, alloying may be carried out at such temperatures so that the tube does not deform. In this case, the external first pressure outside the tube is provided to counteract the vapor pressure inside the tube. This range can even be controlled to minimize the chance of failure in the container (e.g., tube). In another example, alloying may be carried out at temperatures such that the tube is deformable, and such that the external first pressure outside the tube causes the tube to deform such that the open volume of the tube not occupied by the constituents is reduced, e.g., so that the tube collapses at least partially on the alloy/constituents to further force the volatile species into contact with the other constituents and minimize sublimation of the volatile species.

A melt of the constituents can then be formed (step 508), e.g., through the application of additional heat if needed or desirable, and this can be done in the presence of the same first pressure, or a second different, e.g., higher pressure. Thereafter, the melt may be cooled (step 510), e.g., by reducing the pressure in the HIP/pressure furnace, extracting the container 430B, and quenching the container 430B containing the melt, e.g., by quenching in water. The choice of suitable temperatures, heating times and pressures can be determined from experimental testing and/or modeling.

According to another example, a metallic alloy containing P, e.g., a BMG composition, can be prepared using a combination of melt and gas-phase chemistry in a suitable chamber that provides for evacuation, melting, and gas control for phosgene gas. In this regard, one or more constituents are disposed in a container in the chamber and are heated to a temperature sufficient to melt the constituent(s). The melt is then exposed to phosgene gas, which contains phosphorus. Phosphorus of the phosgene gas then diffuses into the melt so as to lower a liquidus temperature of the melt. The temperature of the melt can then be lowered while maintaining the mixture above the liquidus temperature. The composition of the melt can be controlled by continuing the diffusion and/or by adding other constituents until a desired composition is reached. For instance, because the partial vapor pressure of phosphorus above the melt is higher than the equilibrium vapor pressure of phosphorus in the alloy, the phosphorus atoms diffuse into the melt until an equilibrium of activity is achieved. The amount of diffusion can be controlled by adjusting the total pressure exerted over the melt. The melt can then be cooled as described elsewhere herein, thereby forming the metallic alloy. The cooling can be carried out at a rate sufficient to form the alloy into a BMG.

In this regard, a method of preparing a metallic alloy may utilize phosgene gas or phosphorus gas as an aid to providing the proper alloy chemistry. The method may comprise heating one or more constituents of an alloy in a container to a temperature sufficient generate a melt such as described elsewhere herein. The melt may then be exposed to phosgene gas or phosphorus gas in a suitable container, such as a crucible or quartz tube. Diffusion of phosphorus into the melt is then permitted to occur, e.g., so as to lower a liquidus temperature of a melt. The temperature of the melt can then be lowered, e.g., by controlling the power to the heating arrangement (e.g., an induction coil or crucible heater) while maintaining the mixture above the liquidus temperature. The phosgene or phosphorus gas exposure can be continued with continued control of the heating so as to control the composition of the melt until a desired composition is reached, the gas and heating control parameters for which can be determined through experimental testing and/or modeling. The melt can then be cooled, thereby forming a metallic alloy. For instance, because the partial vapor pressure of phosphorus above the melt is higher than the equilibrium vapor pressure of phosphorus in the alloy, the phosphorus atoms diffuse into the melt until an equilibrium of activity is achieved. The amount of diffusion can be controlled by adjusting the total pressure exerted over the melt. The cooling can be carried out a rate sufficient to form a BMG.

In examples described herein, with suitable testing to evaluate the impact of the subliming volatile species on the composition, the composition can be adjusted at the outset of the initial melting to account for any loss of the volatile species (e.g., loss due to sublimation and coating surfaces of the container and/or chamber) so that an alloy of desired composition can be melted and cast in an initially process, e.g., without a need for testing the composition and remelting the alloy with more constituents to achieve the desired alloy chemistry. Thereafter, the initial alloy (which already has the desired composition) can be divided into smaller pieces of desired size and remelted and cast into many ingots of desired size, shape and composition.

In the above described approaches, the constituents may include Pt, Cu, Ni and P so that the metallic alloy formed comprises Pt, Cu, Ni and P. In one example, the metallic alloy may have a composition given by $(Pt,Pd)_x(Cu,Ni)_yP_z$ wherein x ranges from about 20 to 60 atomic percent, y ranges from 15 to 60 atomic percent, and z ranges from about 16 to 24 atomic percent. In another example, the constituents may include Ni, Cr, Nb, P and B. In one example, the alloy may have a composition given by $Ni_{69}Cr_{8.5}Nb_{3.0}P_{16.5}B_{3.0}$. The metallic alloy may be cooled at a cooling rate sufficient so that it is formed as a BMG.

In another example, the metallic alloy may have a composition given by $((Pt,Pd)_{1-x}TM1_x)_a((Cu,Co,Ni)_{1-y}TM2_y)_b(P,Si)_{1-z}SM_z)_c$, wherein a ranges from about 20 to 65 atomic percent, b ranges from about 15 to 60 atomic percent, c ranges from about 16 to 24 atomic percent; wherein the concentration of Pt is at least 10 atomic percent; wherein the concentration of Co is non-zero and the total concentration of Ni and Co in combination is at least 2 atomic percent; wherein the concentration of P is at least 10 atomic percent; wherein TM1 is selected from the group consisting of Ir, Os, Au, W, Ru, Rh, Ta, Nb and Mo; wherein TM2 is selected from the group consisting of Fe, Zn, Ag, Mn and V; wherein SM is selected from the group consisting of B, Al, Ga, Ge, Sn, Sb, and As, wherein x, y and z are atomic fractions such that z is less than about 0.3 and the sum of x, y and z is less than about 0.5, such that when a is less than 35, x is less than about 0.3 and y is less than about 0.1, when a is in the range of from about 35 to 50, x is less than about 0.2 and y is less than about 0.2, and when a is more than 50, x is less than about 0.1 and y is less than about 0.3. The metallic alloy may be cooled at a cooling rate sufficient so that it is formed as a BMG.

Some specific exemplary compositions for the metallic alloy, which may be formed as a BMG according to methods described herein, include the following:

$Pt_{57.5}Cu_{14.7}Ni_{5.3}P_{22.5}$;
$Pt_{44}Cu_{26}Ni_{10}P_{20}$;
$Pt_{44}Cu_{24}Ni_{12}P_{20}$;
$Pt_{44}Cu_{29}Ni_{7}P_{20}$;
$Pt_{44}Cu_{26}Ni_{9}P_{21}$;
$Pt_{56}Cu_{16}Ni_{8}P_{20}$;
$Pt_{68}Cu_{8}Ni_{4}P_{20}$;
$Pt_{57}Cu_{17}Ni_{8}P_{18}$;
$Pt_{57}Cu_{15}Ni_{6}P_{22}$;
$Pt_{57.3}Cu_{14.8}Ni_{6}P_{21.9}$;
$Pt_{57.5}Cu_{14.7}Ni_{5.3}P_{22.5}$;
$Pt_{57}Cu_{14}Ni_{5}P_{24}$;
$Pt_{58}Cu_{16}Ni_{4}P_{22}$;
$Pt_{60}Cu_{14}Ni_{4}P_{22}$;
$Pt_{58}Cu_{12}Ni_{8}P_{22}$;
$Pt_{59}Cu_{15}Ni_{6}P_{20}$;
$Pt_{60}Cu_{16}Ni_{2}P_{22}$;
$Pt_{58.5}Cu_{14.5}Ni_{5}P_{22}$;
$Pt_{62}Cu_{13}Ni_{3}P_{22}$;
$Pt_{58}Cu_{14}Ni_{5}P_{23}$;
$Pt_{60}Cu_{9}Ni_{9}P_{22}$;
$Pt_{59}Cu_{16}Ni_{2}P_{23}$;
$Pt_{61}Cu_{16}Ni_{2}P_{21}$;
$Pt_{57.5}Cu_{15.5}Ni_{6}P_{21}$;
$Pt_{57.5}Cu_{14.5}Ni_{5}P_{23}$;
$Pt_{60}Cu_{20}P_{20}$;
$Pt_{58.5}Cu_{15}CO_{4}P_{22.5}$;
$Pt_{60}CU^{1}{}_{6}CO_{2}P_{22}$;
$Pt_{57.5}Cu_{14.7}Co_{5.3}P_{22.5}$;
$Pt_{42.5}Cu_{27}Ni_{9.5}P_{21}$.

In any of the above-described approaches, the melt of the metallic alloy may be fluxed with boron oxide to enhance the glass forming ability of the alloy, but this is optional and not necessary.

The above described approaches may have benefits over conventional approaches for forming BMG alloys containing P. One conventional technique for making P-containing BMG alloys uses a large crucible and a furnace with a hot zone and a cold zone, such that melting occurs in the hot zone of the crucible and P vapor condenses on the cold zone of the crucible. This technique may create substantial waste and makes it difficult to maintain a desired composition. Other conventional techniques to make P-containing BMG alloys melt the constituent elements in a vacuum induction melting furnace, or tube resistance furnace using a small chamber to reduce the absolute amount of P vapor due to sublimation. This may have risks because the vapor pressure of P can be quite high if it does not enter solution in the melt. Moreover, controlling the chemistry of the alloy is challenging if there is loss of P. The approaches described herein may mitigate these deficiencies.

Additionally, another conventional process for forming BMG alloys containing P involves use of a master alloy containing P and one or more of the elements. For example, Ni—P, Cu—P, or Pt—P may be produced in a separate melting process. In the case of Pt, the addition of P decreases the melting temperature from more than 1750° C. to less than 600° C. This may reduce the complexity of producing such alloys to the extent that the metallurgist can avoid working with elemental P. However, the master alloy must be purchased at added cost, and the composition of the master alloy may not be sufficiently controlled to the extent necessary for the stricter requirements of BMG compositions. For example, commercial grade Ni—P alloy generally maintains control over the P content to 20 wt %±2 wt %, or about ±10% of the nominal P composition. Many BMG alloys require a phosphorus composition to better than 5% of the nominal composition. Thus, use of commercially purchased master alloys, e.g., Ni—P or Fe—P or Cu—P, has drawbacks. The approaches described herein may overcome these drawbacks by simplifying the handling of P in alloy preparation.

Another conventional approach for formation of P-containing alloys involves the plunging of P into a starting alloy, or the use of commercial grade Ni—P or Fe—P. This type of processing may be difficult to control.

While the present invention has been described in terms of exemplary embodiments, it will be understood by those skilled in the art that various modifications can be made thereto without departing from the scope of the invention as set forth in the claims.

What is claimed is:

1. A method of preparing a metallic alloy, comprising:
placing multiple constituents into a container;
heating the multiple constituents in the container to initiate an alloying reaction among the multiple constituents in the presence of an inert atmosphere provided to counter sublimation of a first constituent which is a volatile species of the multiple constituents, the alloying reaction being initiated at a temperature below a melting temperature of the first constituent;
forming a melt of the multiple constituents; and
cooling the melt, thereby forming the metallic alloy.

2. The method of claim 1, wherein the metallic alloy comprises a bulk metallic glass structure.

3. The method of claim 1, wherein the first constituent comprises P.

4. The method of claim 1, wherein one of the constituents comprises an alloy of Pt and P, an alloy of Cu and P, or an alloy of Ni and P.

5. The method of claim 1, the alloying reaction being initiated at a temperature below a sublimation temperature of the first constituent.

6. The method of claim 1, wherein the metallic alloy comprises Pt, Cu, Ni and P.

7. The method of claim 1, wherein the metallic alloy has a composition given by:
$(Pt, Pd)_x(Cu,Ni)_yP_z$ wherein x ranges from about 20 to 60 atomic percent, y ranges from 15 to 60 atomic percent, and z ranges from about 16 to 24 atomic percent.

8. The method of claim 7, wherein the metallic alloy comprises a bulk metallic glass structure.

9. The method of claim 1, comprising fluxing the melt of the metallic alloy with boron oxide.

10. The method of claim 1, wherein cooling the melt comprises water quenching.

11. The method of claim 1, wherein the container is a glass or quartz tube.

12. A method of preparing a metallic alloy, comprising:
placing multiple constituents into a container;
evacuating and sealing the container;
heating the multiple constituents in the container to initiate an alloying reaction among the multiple constituents, the container being in the presence of an external pressure sufficient to counteract a vapor pressure of volatile species inside the container, the alloying reaction being initiated at a temperature below a melting temperature of the volatile species;
forming a melt of the multiple constituents; and
cooling the melt, thereby forming the metallic alloy.

13. The method of claim 12, wherein the container is a glass or quartz tube.

14. The method of claim 12, wherein the metallic alloy comprises a bulk metallic glass structure.

15. The method of claim 12, wherein a constituent is in the form of a powder.

16. The method of claim 15, wherein the constituent in the form of the powder includes P, an alloy of Pt and P, and alloy of Cu and P, or an alloy of Ni and P.

17. The method of claim 12, the alloying reaction being initiated at a temperature below a sublimation temperature of the volatile species.

18. The method of claim 12, wherein said heating is a carried out such that the container deforms.

19. The method of claim 12, comprising fluxing the melt of the metallic alloy with boron oxide.

20. The method of claim 12, wherein cooling the melt comprises water quenching.

21. The method of claim 12, wherein the metallic alloy comprises Pt, Cu, Ni and P.

22. The method of claim 12, wherein the metallic alloy has a composition given by:
$(Pt, Pd)_x(Cu,Ni)_yP_z$ wherein x ranges from about 20 to 60 atomic percent, y ranges from 15 to 60 atomic percent, and z ranges from about 16 to 24 atomic percent.

23. The method of claim 22, wherein the metallic alloy comprises a bulk metallic glass structure.

* * * * *